US005340633A

United States Patent [19]

van der Loo et al.

[11] Patent Number: 5,340,633

[45] Date of Patent: Aug. 23, 1994

[54] MULTILAYER ANTIBALLISTIC STRUCTURE

[75] Inventors: Leonardus L. H. van der Loo, Beek; Marcel D. M. Mertens, Sittard, both of Netherlands

[73] Assignee: DSM, N.V., Heerlen, Netherlands

[21] Appl. No.: 799,175

[22] Filed: Nov. 27, 1991

[30] Foreign Application Priority Data

Nov. 28, 1990 [NL] Netherlands ..... 9002590

[51] Int. Cl.[5] ..... B32B 3/16; B32B 5/12; A41D 15/04; A41H 5/02

[52] U.S. Cl. ..... 428/114; 428/49; 428/911; 428/301; 428/902; 89/36.02; 89/36.05; 2/2.5

[58] Field of Search ..... 428/49, 114, 408, 911, 428/920; 89/36.02, 36.05; 2/2.5

[56] References Cited

U.S. PATENT DOCUMENTS 4,131,053 8/1965 Ferguson ..... 428/469
4,613,535 9/1986 Harpell et al. ..... 428/911
4,869,040 9/1989 Hallal et al. ..... 428/246
4,946,721 8/1990 Kindervater et al. ..... 428/408

FOREIGN PATENT DOCUMENTS

WO9106823 5/1991 PCT Int'l Appl. ..... 428/77
2130073 5/1984 United Kingdom .

*Primary Examiner*—George F. Lesmes
*Assistant Examiner*—Kathryne E. Shelborne
*Attorney, Agent, or Firm*—Cushman, Darby & Cushman

[57] ABSTRACT

A multilayer antiballistic structure having good antiballistic properties comprises a first layer which comprises ceramic tiles and a second layer of composite material which comprises polyalkene filaments having a tensile modulus of at least 40 GPa and a tensile strength of at least 1 GPa and a matrix which at least partially surrounds the polyalkene filaments, while the antiballistic structure comprises, between the first and the second layer an intermediate layer of a material having a flexural modulus which is higher than the flexural modulus of the composite material of the second layer and is lower than the flexural modulus of the ceramic material.

Good results are obtained if the intermediate layer comprises a composite material.

18 Claims, 1 Drawing Sheet

MULTILAYER ANTIBALLISTIC STRUCTURE

BACKGROUND OF THE INVENTION

1. Field of the Invention

The invention relates to a multilayer antiballistic structure comprising a first layer which comprises ceramic tiles and a second layer of composite material which comprises polyalkene filaments having a tensile modulus of at least 40 GPa and a tensile strength of at least 1 GPa and a matrix which at least partially surrounds the polyalkene filaments.

2. Background of the Related Art

Such an antiballistic structure is disclosed by U.S. Pat. No. 4,613,535.

If the known antiballistic structure is struck by a projectile, the second layer will bend appreciably under such circumstances. This effect also occurs if the projectile penetrates the first layer of the ceramic material and the projectile is then stopped in the second layer.

This bending has the disadvantageous consequence that the object or human body to be protected and situated behind the structure is damaged or wounded, respectively. The wounding of a human body in this way is also referred to as the occurrence of a "trauma effect".

During bending, the second layer is also pulled away from one or more tiles which are in contact with the tile struck by the projectile. If the known antiballistic structure is hit by a missile during a subsequent bombardment close by the previous impact on one of the tiles no longer supported by the second layer, for example during bombardment with a repeating weapon, the known antiballistic structure affords a considerably reduced protection.

SUMMARY OF THE INVENTION

The invention has the object of providing an antiballistic structure which does not have the above-mentioned disadvantage. Surprisingly, this is achieved in that the antiballistic structure according to the invention comprises, between the first and second layer, an intermediate layer of a material having a flexural modulus which is higher than the flexural modulus of the composite material of the second layer and is lower than the flexural modulus of the ceramic material of the first layer.

A further advantage of the antiballistic structure according to the invention is that the resistance to penetration of a projectile is at least equal to the resistance to penetration of the known antiballistic structure without the weight per unit surface area of the antiballistic structure having increased with respect with the weight per unit surface area of the known antiballistic structure.

DETAILED DESCRIPTION OF THE PREFERRED EMBODIMENTS

The invention is explained below referring to the figures and is not limited thereto.

Figure 1:
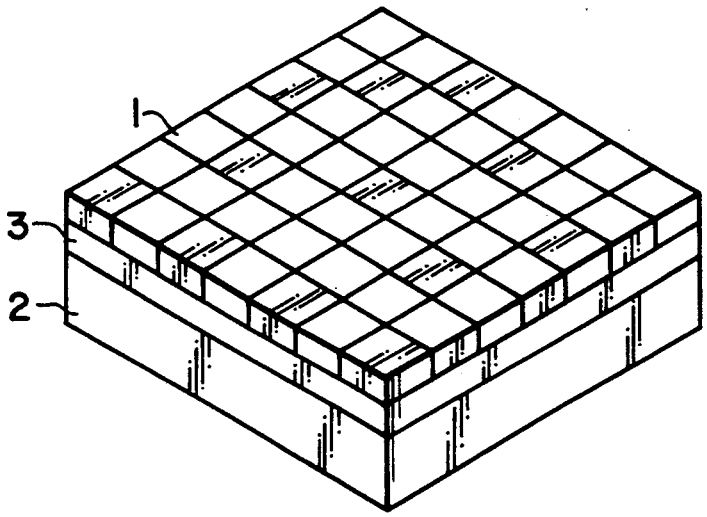
FIG. 1 is a drawing showing a multilayer antiballistic structure according to the invention in perspective view.
Figure 2:
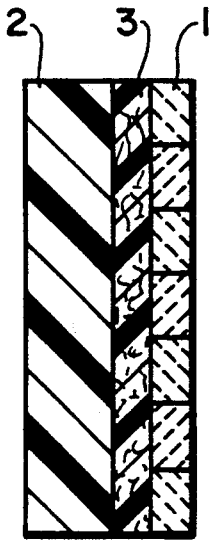
FIG. 2 is a drawing showing a multilayer antiballistic structure according to the invention in a cross-sectional view.

As shown in FIGS. 1 and 2, the invention relates to an antiballistic structure comprising a first layer (1) comprising ceramic tiles, a second layer (2) of composite material comprising polyalkene filaments having the tensile modulus of at least 40 GPa and the tensile strength of at least 1 GPa in a matrix which at least partially surrounds the polyalkene filaments, and an intermediate layers (3) having a flexural modulus which is higher than the flexural modulus of the composite material of the second layer (2) and is lower than the flexural modulus of the ceramic material of the first layer (1).

Good results are obtained if the ceramic material of the first layer of the antiballistic structure has a thickness between 2 and 12 mm. Preferably the ceramic material has a thickness between 4 and 8 mm. Preferably, aluminium oxide, silicon carbide, silicon nitride or boron carbide is chosen as ceramic material.

For the polyalkene filaments of the second layer of the antiballistic structure, linear polyalkene is preferably used as polyalkene.

Linear polyalkene is understood here as meaning polyethylene which has less than 1 side chain per 100 carbon atoms, preferably less than 1 side chain per 300 carbon atoms and which, in addition, may contain up to 5 mol % of one or more other alkenes copolymerisable therewith, such as propylene, butene, pentene, 4-methylpentene, octane.

Other polyalkenes are also suitable, such as, for example, propylene homo- and copolymers.

Furthermore, the polyalkenes used can contain small amounts of one or more other polymers, in particular 1-alkene polymers.

Polyalkene filaments that are very suitable for the object of the invention are obtained if the polyalkene filaments are prepared with the aid of the gel stretching process which is described, for example, in GB-A-2,042,414 and GB-A-2,051,667. Said process can comprise preparing a solution of the polyalkene, which preferably has a weight-average molecular weight of at least 600,000 g/mol, forming the solution into filaments at a temperature above the dissolution temperature, cooling the filaments to below the dissolution temperature so that gelation occurs and stretching the gelated filaments while the solvent is being removed.

Filaments are understood here to mean bodies whose length is great with respect to the height and the width. In the composite material of the second layer of the anti-ballistic structure, the polyalkene filaments can be present in various configurations. Good results are obtained if the filaments are arranged in the form of layers of unidirectional yarns. Preferably, the difference in the orientation direction of the yarns in the successive yarn layers is 90° or approximately 90° . It is also possible that the filaments are present in the form of woven layers.

In general, the weight of the filaments present in the second layer per unit surface area, also referred to as fibre area density (FAD), is 3–20 kg/m$^2$, preferably 6–12 kg/m$^2$.

Depending, inter alia, on the use and possibly the manner of preparation of the composite material, various polymeric materials can be used as matrix. It is important in this connection that the melting point of the matrix, and in the case of thermosets also the curing temperature, are below the melting point of the polyalkene filaments.

Examples of polymeric materials which are suitable to be used as matrix are, inter alia, ABS, plasticised PVC, PE, preferably LLDPE or ethane copolymers. Good results are furthermore obtained with vinyl ester resins, polyester resins, epoxy resins and polyurethane resins.

In general it is found that the antiballistic structure according to the invention offers a good protection against the penetration of a projectile to the extent to which the composite material of the second layer has a lower flexural modulus. As a result of the presence of the intermediate layer, the ceramic material of the first layer in this case retains sufficient support. Preferably, the second layer has a modulus of not more than 10 GPa.

The intermediate layer can in principle comprise any material having a modulus which is higher than the flexural modulus of the composite material of the second layer and is lower than the flexural modulus of the ceramic material of the first layer. Preferably, a material is used which has a high flexural modulus and a low weight. Materials having a flexural modulus which is equal to or higher than the flexural modulus of the ceramic material are not in general suitable because said materials are very brittle, while the improvement in the protection against the penetration of a projectile which is achieved by the presence of such an intermediate layer can also be achieved if the first layer of ceramic material has a greater thickness. Examples of materials which are suitable to be used as intermediate layer are metals, such as copper, aluminium, steel, titanium, metal alloys such as aluminum-magnesium alloys and plastics such as polycarbonate and ABS. An antiballistic structure according to the invention which performs very well is obtained if the weight per unit surface area of the intermediate layer is 0.5–6 kg/m$^2$. Preferably, the weight per unit surface area of the intermediate layer is 1–4 kg/m$^2$.

An antiballistic structure having very good properties and a low weight is obtained if the intermediate layer comprises a composite material. Further advantages of the use of a composite material are the easy moulding to form curved or doubly curved structures and the possibility of integrating the production of the intermediate layer and the second layer.

The composite material of the intermediate layer may comprise, for example, glass filaments or polyaramid filaments and a thermosetting or thermoplastic material as matrix.

Surprisingly, very good results are obtained if the composite material of the intermediate layer comprises carbon filaments. In general, composites which comprise carbon filaments do, after all, have less good antiballistic properties as emerges, for example, from R. C. Liable, Ballistics Materials and Penetration Mechanics, Elsevier 1980, pages 286 to 289 inclusive.

Very good results are also obtained if the composite material of the intermediate layer comprises the polyalkene filaments such as was described above for the second layer.

There are various possibilities for achieving the result that the composite material of the intermediate layer, which comprises the polyalkene filaments, has a higher rigidity than the composite material of the second layer. Thus, it is possible that the intermediate layer comprises more of the polyalkene filaments per unit volume than the second layer. It is also possible that the intermediate layer comprises a matrix having a higher modulus than the matrix of the second layer.

Very good results are obtained if the higher modulus of the intermediate layer is achieved in that the polyalkene filaments of the intermediate layer are more completely surrounded by the matrix than the polyalkene filaments of the second layer. Such a multilayer anti-ballistic structure is obtained by compression moulding the intermediate layer during the preparation process for a longer time or at a higher temperature or at a higher pressure than the second layer. Good results are obtained in this way if the matrix of the intermediate layer and the matrix of the second layer comprise polyethylene or a copolymer of polyethylene.

In another embodiment, the polymer which forms the matrix of the intermediate layer has a lower viscosity than the polymer which forms the matrix of the second layer. Preferably, the lower viscosity is achieved in that the polymer of the intermediate layer has a lower molecular weight than the polymer of the second layer or in that it is a copolymer which has at least one monomer in common with the polymer of the second layer. This achieves the result that the intermediate layer and the second layer can be prepared in one compression moulding step, while the two layers adhere well to each other. Good results are obtained in this way if the matrix of the intermediate layer and the matrix of the second layer comprise polyethylene or a copolymer of polyethylene.

The invention is explained further with reference to the examples without being limited thereto.

COMPARATIVE EXPERIMENT A

A woven fabric is composed of Dyneema (TM) SK 66 polyethylene yarns having a titre of 1,600 denier. Dyneema SK 66 is supplied by DSM HPF in Holland. The woven fabric has a 1×3 twill structure and contains 17 yarns per cm in the warp direction and weft direction. Three composite panels which comprise polyethylene filaments have been produced by stacking pieces of the woven fabric measuring 30×30 cm alternately with pieces of low-density polyethylene film having the same dimensions and compression moulding the stack obtained in this way between two flat platens. Stamylan (TM) LD NC 514 supplied by DSM in Holland has been used as low-density polyethylene. The compression moulding time was 15 min and the compression moulding temperature was 125° C. The compression moulding pressure and the number of pieces of woven fabric are given in Table 1 for each composite panel.

Antiballistic structures have been obtained by gluing ceramic tiles of the type Sphinx Alodens (TM) 99 to one side of the composite panels thus obtained in virtually close-fitting manner. The modulus of the ceramic tiles is 402 GPa. The length and the width of the tiles is 40×40 mm. The thickness of the tiles is given in Table 1 for each antiballistic structure. The ceramic tiles are supplied by Sphinx Technical Ceramics Division in Holland.

A mixture of Ancarez (TM) 300, Ancamine (TM) MCA and Araldit (TM) LY 556 has been used as glue in a quantitative ratio of 50:23:50 parts by weight. The glue has been set in the course of 2 hours at 80° C.

Ancarez (TM) 300 and Ancamine (TM) MCA are supplied by Anchor Chemical in Great Britain. Araldit (TM) LY 556 is supplied by Ciba Geigy in Switzerland.

The antiballistic properties of the antiballistic structure thus obtained has been determined in accordance with DIN 52 290. 762*51 Armour Piercing supplied by FN in Belgium has been used as munition.

The results are given in Table 1.

TABLE 1

| pieces of woven fabric [−] | $v_{in}$ [bar] | $v_{out}$ compression moulding pressure [kg] $m^2$ | B.L.A.D. thickness [mm] | B.L.A.D. [kg] $m^2$ | tile [m] s | T.A.D. [m] s |
|---|---|---|---|---|---|---|
| 70 | 10 | 12.5 | 6 | 36.1 | 797 | 438 |
| 51 | 25 | 9.2 | 7 | 36.3 | 798 | 370 |
| 40 | 50 | 7.1 | 8 | 38.4 | 801 | 544 |

B.L.A.D. = weight per unit surface area of second layer
T.A.D. = weight per unit surface area of antiballistic structure.
$v_{in}$ = the projectile velocity at the instant when the antiballistic structure is hit.
$v_{out}$ = the projectile velocity after the projectile has pierced the antiballistic structure ($v_{out}$ = 0 denotes: no complete penetration).

As is evident from Table 1, all the ballistic structures are completely pierced in this experiment.

Furthermore, the second layer has bent an appreciable distance after a bullet impact and is largely pulled away from the tiles of the first layer which are in contact with the tile struck.

EXAMPLE I

A composite panel which comprises the polyethylene filaments has been manufactured by the method as specified in comparative experiment A. The compression moulding pressure and the number of pieces of woven fabric are given in Table 2.

An aluminium panel has been glued to one side of the composite panel in the manner specified in comparative experiment A. Type 5754 supplied by Alusuis in Switzerland has been used as aluminium. The thickness of the aluminium panel is 1.0 mm.

The ceramic tiles have been glued to the aluminium plate in the manner specified in comparative experiment A. The thickness of the ceramic tiles is given in Table 1.

The antiballistic structure thus obtained has been tested according to the method given in comparative experiment A. The results are given in Table 2.

TABLE 2

| pieces of woven fabric [−] | $v_{in}$ [bar] $m^2$ | $v_{out}$ compression moulding pressure [kg] | B.L.A.D. thickness [mm] $m^2$ | B.L.A.D. [kg] s | tile [m] s | T.A.D. [m] |
|---|---|---|---|---|---|---|
| 42 | 25 | 7.6 | 7 | 36.0 | 808 | 0 |

Composition of the results from Table 1 and Table 2 reveals that an appreciable improvement of the anti-ballistic properties occurs as a result of the provision of a hard intermediate layer of aluminium.

Furthermore, the second layer is not or is hardly bent by a bullet impact. The tiles of the first layer which are in contact with the tile struck are still completely supported after the impact by the hard inter-mediate layer and the second layer.

EXAMPLE II

Three composite panels which comprise the polyethylene filaments have been produced according to the method as specified in comparative experiment A. The compression moulding pressure was 25 bar and the number of pieces of woven fabric was 51. Three composite panels containing carbon fibres were also produced to act as hard inter-mediate layer. The panels have been produced by compression moulding together a number of layers of Hexcel (TM) F 155 prepreg, which contains unidirectionally arranged carbon filaments and an epoxy resin, and curing at 120° C. for 90 minutes. The layers of prepreg have been stacked in a manner such that the carbon filaments are arranged at an angle of 90° in successive layers. The number of layers of prepreg and the weight per unit surface area are shown in Table 3. Three antiballistic structures have been obtained by gluing the composite panel containing the polyethylene filaments to the composite panels containing the carbon fibres at one side of the composite panel and by gluing the ceramic tiles from Example I to the other side. The gluing has been carried out as described in comparative experiment A.

The antiballistic structures thus obtained have been tested by the method given in comparative experiment A. The results are shown in Table 3.

TABLE 3

| B.L.A.D. [kg] $m^2$ | layers of prepreg [−] | I.L.A.D. [kg] $m^2$ | tile thickness [mm] | T.A.D. [kg] $m^2$ | $v_{in}$ [m] s | $v_{out}$ [m] s |
|---|---|---|---|---|---|---|
| 9.2 | 15 | 2.79 | 7 | 35.3 | 805 | 0 |
| 9.2 | 12 | 2.21 | 7 | 34.7 | 802 | 452 |
| 9.2 | 9 | 1.61 | 7 | 34.1 | 806 | 468 |

I.L.A.D. = weight per unit surface area of intermediate layer.

Furthermore, the second layer is not, or is hardly, bent by a bullet impact. The tiles of the first layer which are in contact with the tiles struck are still completely supported by the hard intermediate layer and the second layer after the impact.

EXAMPLE III

Three composite panels comprising the polyethylene filaments have been produced by the method as specified in comparative experiment A. The number of pieces of woven fabric was 15.

The panels have been compression moulded under a relatively high pressure of 50 bar. As a result, panels have been obtained which have a relatively high modulus. A relationship between the compression moulding pressure and the modulus is given in Table 4.

After the panels have been pressed, but before the panels have cooled, a stack which comprises the pieces of woven fabric and the pieces of film, as described in comparative experiment A, has been positioned on the panels and the panels have been pressed together with the stack at a lower pressure. The number of pieces of woven fabric was 51. The compression moulding pressure is given in Table 5.

Three panels have been obtained in this way which comprise a layer having a relatively high flexural modulus and a layer having a lower flexural modulus.

Three antiballistic structures have been obtained by gluing the ceramic tiles to the layer of the composite panels having a relatively high flexural modulus as specified in comparative experiment A. In the anti-ballistic structures, the layer having the relatively high flexural modulus is therefore present as the inter-mediate layer.

The antiballistic structures thus obtained have been tested by the method given in comparative experiment A. The results are shown in Table 5.

TABLE 4

| compression moulding pressure [bar] | flexural modulus [GPa] |
|---|---|
| 5 | 3 |
| 10 | 5 |
| 25 | 9 |
| 50 | 15 |

TABLE 5

| B.L.A.D. $v_{in}$ $v_{out}$ [kg] / $m^2$ | I.L.A.D. [kg] / $m^2$ | compression moulding pressure [bar] | thickness [mm] | [kg] / $m^2$ | tile [m] / s | T.A.D. [m] / s |
|---|---|---|---|---|---|---|
| 9.0 | 3.0 | 5 | 6 | 35.4 | 800 | 0 |
| 8.9 | 3.0 | 10 | 6 | 35.3 | 804 | 0 |
| 9.0 | 2.9 | 25 | 6 | 35.3 | 800 | 457 |

Furthermore, the second layer is not, or is hardly, bent by a bullet impact. The tiles of the first layer which are in contact with the tile struck are still completely supported by the hard intermediate layer and the second layer after the impact.

COMPARATIVE EXPERIMENT B

An antiballistic structure has been produced by the method described in Example 4, but with the difference that the layer having the relatively high flexural modulus forms the second layer and the layer with the lower flexural modulus forms the intermediate layer.

The antiballistic structure thus obtained has been tested by the method given in comparative experiment A. The compression moulding pressure and the results are shown in Table 6.

TABLE 6

| B.L.A.D. $v_{in}$ $v_{out}$ [kg] / $m^2$ | I.L.A.D. [kg] / $m^2$ | compression moulding pressure [bar] | thickness [mm] | [kg] / $m^2$ | tile [m] / s | T.A.D. [m] / s |
|---|---|---|---|---|---|---|
| 3.0 | 9.1 | 25 | 6 | 35.5 | 806 | 438 |

Comparison of the results from comparative experiment B and Example 4 reveals that the protective action of the antiballistic structure is markedly better if the intermediate layer has a higher flexural modulus than the second layer. In the case of the antiballistic structure, the intermediate layer and the second layer have also been pulled away to an appreciable distance from the tiles of the first layer which are in contact with the tile struck.

We claim:

1. Multilayer antiballistic structure comprising:
a first layer which comprises ceramic tiles;
a second layer of composite material which comprises polyalkene filaments having a tensile modulus of at least 40 GPa and a tensile strength of at least 1 GPa, and a matrix which at least partially surrounds the polyalkene filaments; and
an intermediate layer disposed between the first and second layers, the intermediate layer being comprised of a material having a flexural modulus higher than the flexural modulus of the composite material of the second layer and lower than the flexural modulus of the ceramic material of the first layer.

2. Multilayer antiballistic structure comprising:
a first layer comprising ceramic tiles;
a second layer of composite material comprising polyalkene filaments having a tensile modulus of at least 40 GPa a tensile strength of at least 1 GPa and a flexural modulus of not more than 10 GPa, and a matrix which at least partially surrounds the polyalkene filaments; and
an intermediate layer disposed between the first and second layers, the intermediate layer comprising a material having a flexural modulus higher than the flexural modulus of the composite material of the second layer and lower than the flexural modulus of the ceramic material of the first layer.

3. Multilayer antiballistic structure according to claim 1, wherein the weight per unit surface area of the intermediate layer is 0.5–6 kg/$m^2$.

4. Multilayer antiballistic structure according to claim 1, the weight per unit surface area of the intermediate layer is 1–4 kg/$m^2$.

5. Multilayer antiballistic structure according to claim 1, wherein the inter-mediate layer comprises a composite material.

6. Multilayer antiballistic structure according to claim 5, wherein the composite material of the intermediate layer comprises carbon filaments.

7. Multilayer antiballistic structure comprising:
a first layer comprising ceramic tiles;
a second layer of composite material comprising polyalkene filaments having a tensile modulus of at least 40 GPa and a tensile strength of at least 1 GPa, and a matrix which at least partially surrounds the polyalkene filaments; and
an intermediate layer disposed between the first and second layers, the intermediate layer comprising a composite material comprising polyalkene filaments having a tensile modulus of at least 40 GPa, a tensile strength of at least 1 GPa, and a flexural modulus higher than the flexural modulus of the composite material of the second layer and lower than the flexural modulus of the ceramic material of the first layer.

8. Multilayer antiballistic structure according to claim 7, wherein the polyalkene filaments of the intermediate layer are more completely surrounded by the matrix that the polyalkene filaments of the second layer.

9. Multilayer antiballistic structure according to claim 8, wherein the intermediate layer is pressed for a longer time and/or at a higher temperature and/or at a higher pressure than the second layer.

10. Multilayer antiballistic structure according to claim 8, wherein the polymer which forms the matrix of the intermediate layer has a lower viscosity than the polymer which forms the matrix of the second layer.

11. Multilayer antiballistic structure according to claim 8, wherein the matrix of the intermediate layer and the matrix of the second layer comprise polyethylene or a copolymer of polyethylene.

12. Multilayer antiballistic structure according to claim 7, wherein the second layer has a flexural modulus of not more than 10 GPa.

13. Multilayer antiballistic structure according to claim 7, wherein the weight per unit surface area of the intermediate layer is 0.5–6 kg/$m^2$.

14. Multilayer antiballistic structure according to claim 7, wherein the weight per unit surface area of the intermediate layer is 1–4 kg/$m^2$.

15. Multilayer antiballistic structure according to claim 2, wherein the weight per unit surface area of the intermediate layer is 0.5–6 kg/m$^2$.

16. Multilayer antiballistic structure according to claim 2, wherein the weight per unit surface area of the intermediate layer is 1–4 kg/m$^2$.

17. Multilayer antiballistic structure according to one of claim 2, wherein the intermediate layer comprises a composite material.

18. Multilayer antiballistic structure according to claim 2, wherein the composite material of the intermediate layer comprises carbon filaments.

* * * * *